United States Patent [19]

Winberg et al.

[11] 3,957,310

[45] May 18, 1976

[54] TUNNEL BORING MACHINE WITH DUAL SUPPORT MEMBERS

[76] Inventors: Douglas F. Winberg, 1171 Sycamore Drive, S.E., Issaquah, Wash. 98027; Norman D. Dyer, 5825 Pinkstaff Lane, Beaumont, Tex. 77706

[22] Filed: Jan. 2, 1974

[21] Appl. No.: 430,191

[52] U.S. Cl. ..... 299/31; 299/56

[51] Int. Cl.[2] ..... E21D 9/00; E01G 3/04

[58] Field of Search ..... 299/31, 56, 33; 175/76, 175/94; 61/45 D

[56] References Cited

UNITED STATES PATENTS

| | | | |
|---|---|---|---|
| 3,418,022 | 12/1968 | Peterson | 299/31 |
| 3,459,452 | 8/1969 | Schnabel, Jr. | 299/31 |
| 3,584,918 | 6/1971 | Gaglione | 299/31 |
| 3,598,445 | 8/1971 | Winberg | 299/31 |
| 3,776,595 | 12/1973 | Winberg | 299/31 |

FOREIGN PATENTS OR APPLICATIONS

| | | | |
|---|---|---|---|
| 1,758,165 | 1/1971 | Germany | 299/31 |

*Primary Examiner*—Ernest R. Purser
*Assistant Examiner*—William F. Pate III

[57] ABSTRACT

A tunnel boring machine comprising a rotary cutterhead assembly, a cutterhead support assembly on which the cutterhead assembly is mounted, a gripper assembly for gripping the wall of the tunnel, and a pair of elongate support members connecting the cutterhead support assembly and the gripper assembly. The support members each have a torque reaction end connected either to the gripper assembly or to the cutterhead support assembly. Apparatus associated with the torque reaction ends prevents pivotal movement thereabout of the support members in the plane perpendicular to the plane in which the support members lie.

13 Claims, 6 Drawing Figures

TUNNEL BORING MACHINE WITH DUAL SUPPORT MEMBERS

BACKGROUND OF THE INVENTION

1. Field of the Invention

The present invention relates to tunnel boring machines of the type which move progressively through a tunnel while boring the same. Such machines are of necessity quite large and the space available in a tunnel is limited. Thus there is in this field a continual search for new ways to conserve space in the tunnel by efficient arrangement of the parts of the tunnel boring machine.

Another goal is to achieve versatility, i.e. to allow various parts of the tunnel boring machine as well as other equipment to be located in any one of a number of possible places in accord with the needs of a particular drilling job. This in turn allows the workers to move more freely about the tunnel space and to perform their tasks more easily.

2. Brief Descriptionn of the Prior Art

One of the most popular types of tunnel boring machines has been the type shown in U.S. Pat. No. 3,598,445. This type of machine generally comprises a rotary cutterhead assembly, with cutting means on its forward face, rotatably mounted on a cutterhead support assembly. The axis of rotation is generally coincident with the longitudinal centerline of the tunnel. A main beam extends from the cutterhead support assembly along this axis, and a gripper assembly is slidably mounted thereon. Hydraulic drive cylinders interconnecting the gripper assembly and the cutterhead support assembly serve to drive the cutterhead and cutterhead support forward against the end face of the tunnel when the grippers of the gripper assembly are engaging the tunnel wall. They are also operative to pull the gripper assembly forward on the main beam when its grippers are disengaged.

In such machines it is necessary to provide some means for transmitting torque from the cutterhead support assembly to the gripper assembly, via the main beam, during drilling. This is particularly true of those machines in which the cutterhead support assembly is mounted on the forward end of the main beam by means of a ball joint or other type of universal joint. One common way of doing this is to provide a special set of hydraulic torque reaction cylinders interconnecting the cutterhead support assembly and the main beam. In some cases, where the cutterhead support assembly is mounted on a universal joint, the cylinders used to control vertical and horizontal attitude of the cutterhead support assembly relative to the main beam may also be used to transmit the torque.

In order to conserve space in such a machine, the conveyor used to carry cuttings to the rear of the machine is disposed within the main beam. The relative positions of the parts of the machine, as described above, are dictated by the nature of the machine and particularly by the main beam. There is little versatility in such a structure. Furthermore, the main beam, located in the center of the tunnel, occupies the most valuable space and divides the remaining space so that no large open area is available in the vicinity of the machine.

SUMMARY OF THE INVENTION

In accord with the present invention the main beam of the tunnel boring machine is eliminated and replaced by two beams or support members disposed on opposite sides of the machine axis. This leaves a large open area in the center of the tunnel between the cutterhead support assembly and the gripper assembly. The support members however need not take up substantial additional space at the sides of the tunnel. For example, in a preferred embodiment, the support members are hollow telescoping members and the hydraulic drive cylinders are disposed therein. Thus the support members with the cylinders inside take up little more space than the cylinders alone would occupy.

Thus one object of the invention is to provide a tunnel boring machine having two support members on opposite sides of its axis thereby eliminating the need for a centrally located main beam. Another object is to provide such a machine in which the drive cylinders are located within the support members.

Because there are two support members they can transmit torque from the cutterhead support assembly to the gripper assembly during drilling, without any special bearing arrangement or other space consuming torque reaction apparatus, provided each support member is prevented from pivoting about one of its ends, the torque reaction end, in a plane substantially perpendicular to the plane in which the support members lie. For example if the support members lie at the sides of the tunnel thus generally defining or lying in a horizontal plane, means must be provided preventing vertical pivotal movement of the support members about their respective torque reaction ends relative to the connected assemblies of the machine. For purposes of proper torque transmission the torque reaction end of each of the support members may be either the end connected to the cutterhead support assembly or the end connected to the cutterhead support assembly or the end connected to the gripper assembly, or possibly both ends depending on other engineering requirements.

Thus another object of the invention is to provide a tunnel boring machine comprising dual support members each having a torque reaction end and means associated with each torque reaction end to prevent pivotal movement of the support member about its torque reaction end relative to the connected assembly of the machine in a plane perpendicular to the plane in which the support members lie.

In a preferred embodiment, a certain amount of movement is provided in the connections between the support members and the cutterhead support assembly and gripper assembly to allow the support members to pivot in the plane in which they lie. Thus the drive cylinders can be used to assist in steering the machine by advancing one drive cylinder and the related support member while holding the other fixed or retracting it.

Thus still another object of the present invention is to provide a tunnel boring machine in which the drive cylinders can be used for auxiliary steering purposes.

Other objects, features, and advantages of the invention will be made apparent by the following detailed description, the drawings, and the claims.

DESCRIPTION OF THE PREFERRED EMBODIMENTS

Figure 2:
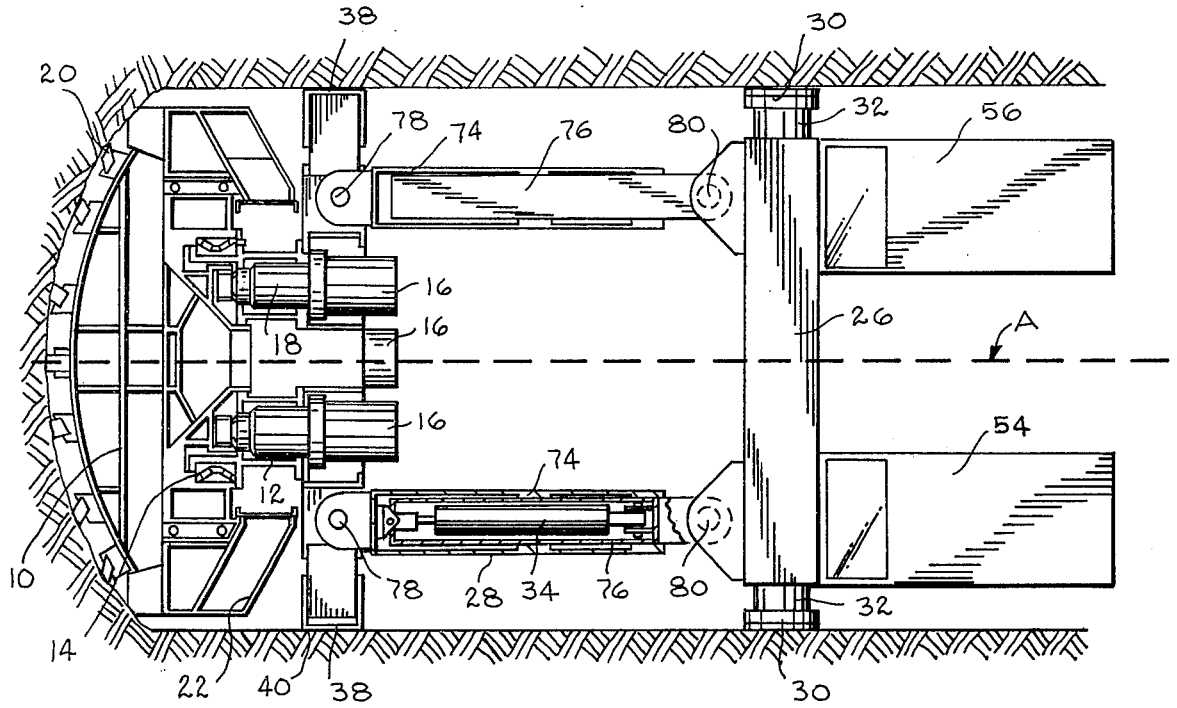
FIG. 2 is a horizontal sectional view of the tunnel boring machine of FIG. 1, taken along lines 2—2 thereof.

Referring now to FIGS. 1–4, the tunnel boring machine comprises a rotary cutterhead assembly 10 rotatably mounted on a cutterhead support assembly 12 by bearings 14. Electric motors 16 each having an associated gear box 18 may be provided for rotating the cutterhead assembly 10 on the cutterhead support assembly 12. The axis A, about which the cutterhead assembly 10 rotates, is generally coincident with the longitudinal centerline of the tunnel being bored. The machine is designed to be disposed inside the tunnel and to move progressively therethrough as it drills the same. On the forward face of the cutterhead assembly 10 are mounted a plurality of cutting means 20 for contacting and breaking away the face of the tunnel. A number of buckets 22 are mounted on the outer periphery of the cutterhead assembly. As they rotate with the cutterhead assembly 10, the buckets 22 scoop up the rock fragments from the bottom of the tunnel and carry them to the top of the machine and dump them into a chute 24. The chute 24 directs the fragments onto a conveyor 27 which carries them to the rear of the tunnel boring machine from whence they can be removed in any suitable manner.

A gripper assembly 26 is located to the rear of the cutterhead support assembly and joined thereto by a pair of support members 28 located on opposite sides of the axis A so as to define a generally horizontal plane. Note that the terms "vertical" and "horizontal" as used herein refer to positions with respect to the machine unless otherwise stated. The design of the support members 28, to be described more fully below, allows for longitudinal movement of the gripper assembly 26 relative to the cutterhead support assembly 12. The gripper assembly 26 may comprise a pair of gripper shoes 30 mounted on hydraulic rams 32. The rams 32 and gripper shoes 30 are horizontally radially extensible and retractable into and out of engagement with the tunnel wall. During drilling the cutterhead support assembly, together with the cutterhead assembly, is driven forward by a pair of hydraulic cylinders 34. At this time the gripper shoes 30 are in their extended position in contact with the tunnel wall. The gripper assembly 26 thus provides the necessary reaction to the thrust of the cylinders 34. When the cylinders 34 have been extended as far as possible (or as far as desired), the gripper shoes 30 are retracted and the cylinders 34 can be retracted so as to pull the gripper assembly 26 forward relative to the cutterhead support assembly 12. In this mode a pair of rear support feet 36 mounted on the gripper assembly 26 may be lowered by means of associated hydraulic rams 37 or the like to support the rear end of the machine while the gripper shoes 30 are disengaged from the tunnel wall. The feet 36 can slide along the bottom of the tunnel while the gripper assembly 26 is being moved forward. When the cylinders 34 have been retracted as much as is desired, the gripper shoes 30 can be extended to engage the tunnel wall, the feet 36 can be retracted if desired, and drilling may be resumed.

A number of steering shoes may be mounted on the cutter-head support assembly 12. Horizontal steering shoes 38 may be located at the sides of the machine. Each of the horizontal steering shoes 38 has a wall contacting portion 40 and a lower extension 42 which projects downwardly and radially inwardly from the wall contacting portion. The horizontal steering shoes 38 are mounted on hydraulic rams 44 or the like which can be selectively urged radially outwardly. The lower portions 42 of the horizontal steering shoes 38 are pivoted to the cutterhead support assembly 12 by pins 46 to allow for movement of the shoes 38 by the rams 44. When it is desired to steer the tunnel boring machine to the right, the shoe 38 on the left of the machine is extended against the side of the tunnel so as to push the front end of the machine to the right. Similarly, the shoe 38 on the right of the machine can be extended to shove the machine to the left.

A vertical steering shoe 48 may be mounted on the bottom of the cutterhead support assembly and connected to a pair of hydraulic rams 50. The shoe 48 slides along the bottom of the tunnel as the machine progresses therethrough. The shoe 48 is pivoted to an extension of the cutterhead support assembly 12 by the pins 52 (only one of which is shown) located forward of the rams 50. Thus by extending and retracting the rams 50 the front of the machine can be tilted up or down to steer it vertically.

Carried on the gripper assembly 26 on opposite sides of the axis A are a cab 54 for the machine operator and a compartment 56 for housing hyraulic pumps and other equipment associated with the machine. A shield may be provided along the crown of the tunnel between the cutterhead support assembly 12 and the gripper assembly 26 to protect workers and the machine itself from falling debris. The structure of the shield is described more fully in our copending application Ser. No. 363,035. Briefly the shield comprises a number of telescoping bars running parallel to the axis A and supported by respective front and rear arcuate frames 60 and 62. The front frame 60 is flexibly supported from the cutterhead support assembly 12 by hydraulic cylinders 64. The rear frame 62 is supported from the gripper assembly 26 by hydraulic cylinders 66. The bars 58 are telescoping so as to accomodate relative longitudinal movement of the gripper assembly and the cutterhead support assembly. A shell-like shield 68 for protection of the rear of the machine may extend rearwardly from the rear frame 62 and be supported on the cab 54 and compartment 56 by suitable bracing members 70 connected to the shield 68 by a suitable connection 72.

Turning now to a more detailed description of the support members 28, it will be seen that each of the support members 28 comprises a pair of telescoping support elements, an outer support element 74 and an inner support element 76. The longitudinally outermost end of each of the outer support elements 74 forms the forward end of the respective support member 28 and may be connected to the cutterhead support assembly 12 by a vertical pivot pin 78. The longitudinally outermost end of each of the inner support elements 76 forms the rear end of the respective support member 28 and may be connected to the gripper assembly 26 by a vertical pivot pin 80.

In order for the support members 28 to transmit torque from the cutterhead support assembly 12 to the gripper assembly 26, each of the support members 28 must have a torque reaction end and means associated with the torque reaction end operative to prevent pivotal movement of the support member about said torque reaction end relative to the connected assembly of the machine in a plane transverse to, or more particularly substantially perpendicular to the plane defined generally by the support members, i.e. the general plane in which they lie.

For example, in the embodiment shown, the support members lie in or define a generally horizontal plane. Thus there must be means associated with the torque reaction end of each of the support members 28 preventing vertical pivotal movement of the support member about the torque reaction end, relative to the cutterhead support assembly if the torque reaction end is the forward end, and relative to the gripper assembly if the torque reaction end is the rear end. It will be understood that, while a three dimensional object such as one of the support members cannot literally move in or define a plane, this language can be understood to refer to the plane which is generally defined by the centerlines of the support members and the perpendicular planes in which these centerlines might move. Similarly, since such movement is defined with respect to the connected assembly of the machine, it will be understood that it might be the assembly rather than the support member which is actually prevented from so moving.

Considering only the objective of torque transmission, it is, , as stated above, merely necessary to have one torque reaction end on each of the support members, and this torque reaction end may be either the front or the rear end. However, as will be explained more fully below, both of the assemblies connected to the support members, i.e. the cutterhead support assembly and the gripper assembly, must be stabilized. One effective way of accomplishing this stability is to prevent both ends of the support members from pivoting perpendicular to the plane in which they lie relative to their respective connected assemblies.

In the embodiment shown, both ends of each support member 28 may serve as torque reaction ends as the vertical pivot pins 78 and 80 allow horizontal pivotal movement of the support members but prevent vertical pivotal movement. However, for torque transmission purposes it is only necessary that one end of each support member serve as a torque reaction end. For example one end of the support member might be pivoted to the connected assembly (either the cutterhead support assembly or the gripper assembly) by a horizontal pin and the other end pivoted to the connected assembly by a vertical pin. If the support members lie in or define a horizontal plane as shown, the ends with the vertical pivot pins would be the torque reaction ends. If the support members lie in or define a vertical plane, the ends with the horizontal pins would be the torque reaction ends. However, as stated above, good engineering will usually dictate that the non torque reaction ends be somehow stabilized relative to their connected assemblies.

Figure 3:
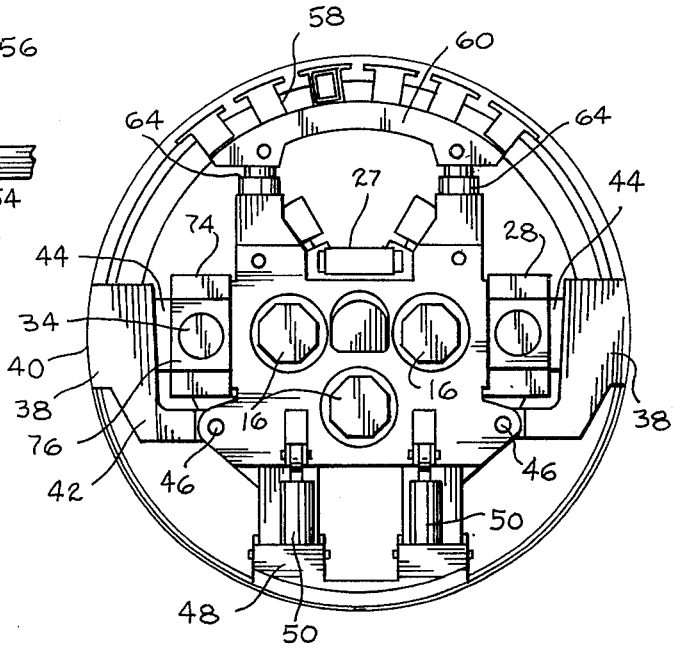
FIG. 3 taken along lines 3—3 of FIG. 1 is a transverse cross sectional view of the machine of FIGS. 1 and 2.
Figure 4:
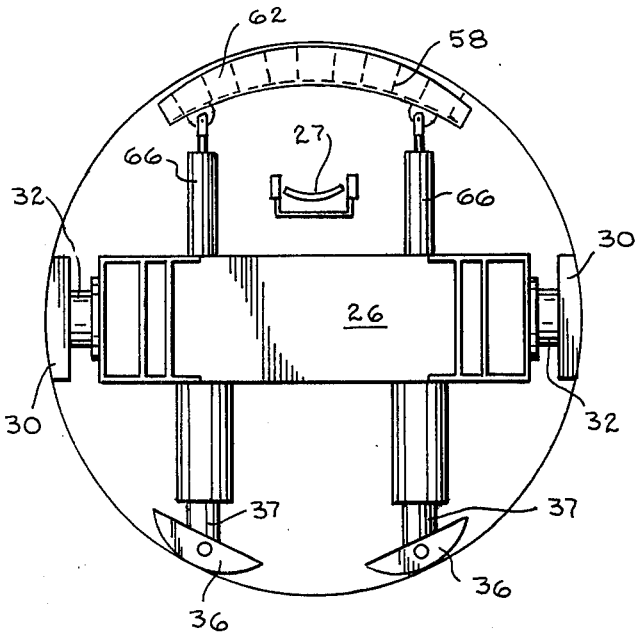
FIG. 4 is a transverse cross sectional view of the machine of FIGS. 1–3; taken along lines 4—4 in FIG. 1.
Figure 5:
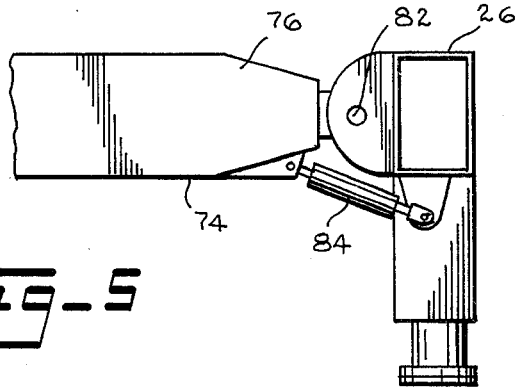
FIG. 5 is a detail view on a larger scale of another embodiment of the invention showing an alternative means of attaching the rear end of one of its support members to its gripper assembly.

Many modifications of the embodiment shown in FIGS. 1–4 are possible. For example, means other than suitably disposed pivot pins can be associated with the torque reaction ends to prevent pivotal movement as necessary. One such alternative is shown in FIG. 5. In this modification the rear end of the support member is provided with a horizontal pivot pin 82 between the rear end of the inner support element 76 and the gripper assembly 26. Thus vertical pivotal movement is allowed. However such movement can be selectively prevented by fixing the hydraulic fixing ram assembly 84 after the support member and gripper assembly are in the desired relative orientation. Thus the rear end of the support member still serves as the torque reaction end while the ram 84 serves as the means associated with the torque reaction end. It will be appreciated that the present invention substantially reduces and simplifies torque transfer problems of prior art machines.

It will also be readily appreciated that the forward end of the support member could be similarly modified with the provision of a horizontal pivot pin in combination with a fixing ram assembly and still serve as a torque reaction end. Furthermore either end of the support member could be provided with a universal joint for pivotal connection to the connected assembly of the machine and a fixing ram for selectively fixing the support member and the connected assembly against vertical pivotal movement about the torque reaction end.

It should be noted that in the design shown in the drawings it is necessary to provide stabilizing means for the rear of the machine. For example if the front end of the support member were the torque reaction end and the rear end were connected to the gripper assembly by a horizontal pin or a universal joint, it would be necessary to provide some means for supporting the rear of the support member relative to the gripper assembly when the gripper shoes are disengaged from the tunnel walls. Suitable means for accomplishing this would be a fixing ram as shown in FIG. 5 at 84. However, as explained above, such a cylinder would also render the rear end of the support member a torque reaction end. Thus it is possible to provide a single means at the rear end of the support member to serve both of these functions.

Similarly, if the cutterhead support assembly is connected to the support members by horizontal pins or universal joints, some means must be provided to stabilize the cutterhead support assembly and cutterhead assembly against unlimited or ramdom pivotal movement whereby they might, for example, pivot backwardly toward the support members displacing the cutterhead from its proper position relative to the end face of the tunnel. As in the case of the rear end of the support members, a fixing ram may be provided interconnecting each of the support members and the cutterhead support assembly to selectively limit relative vertical pivotal movement between the cutterhead support assembly and the support members. And again, such a fixing ram would automatically render the front end of each support member a torque reaction end.

However, it will be appreciated by those skilled in the art that there are other methods of stabilizing either of the assemblies connected to the support members which would not necessarily render the respective ends of the support members torque reaction ends.

The telescoping support members 74 and 76 may be hollow so that the drive cylinders 34 may be disposed therein as shown in FIG. 2. Thus the support members 28 and the cylinders 34 take up little more space than the cylinders alone would occupy. Yet the use of the dual support members eliminates the need for a central main beam and thus provides a large open area between the cutterhead support assembly and the gripper assembly in the center of the tunnel where space is most needed. The drive cylinders could also be disposed on or immediately adjacent the support members with much the same effect.

Figure 1:
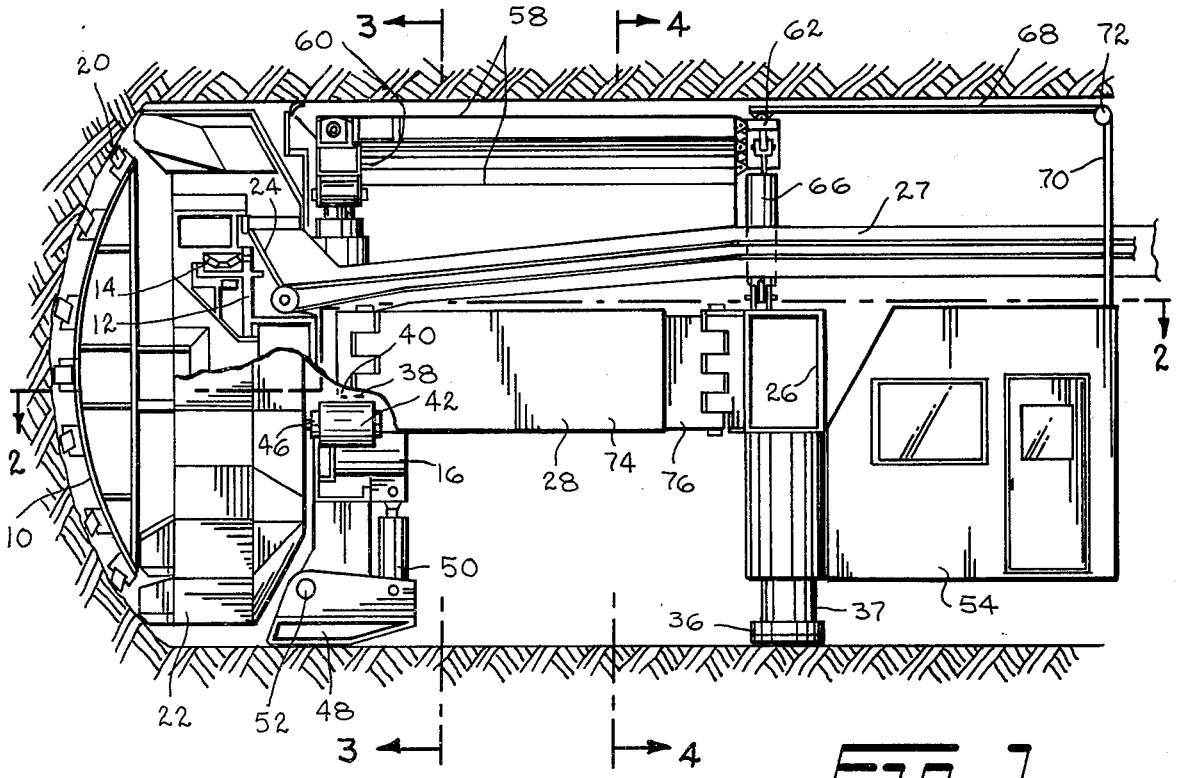
FIG. 1 is a side elevational view of a tunnel boring machine according to a preferred embodiment of the present invention with parts broken away and parts shown in section.
Figure 6:
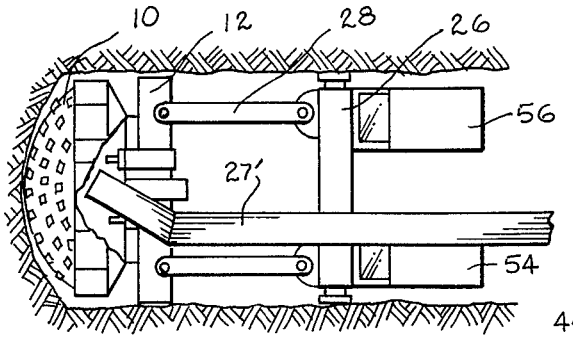
FIG. 6 is a diagramatic plan view of a tunnel boring machine with dual support members showing an alternative location of the conveyor.

Another advantage provided by the present invention is that the conveyor can be located in many different places according to the needs in a particular case. In particular, it may be disposed in a location substantially spaced from the axis of the machine so as to provide further free space near the center of the tunnel. In FIGS. 1, 3 and 4, the conveyor 27 is shown in an upper central position. In FIG. 6, there is shown diagramatically a tunnel boring machine, similar to that of FIGS. 1–4, but in which the conveyor is located in an upper side position lying generally along one of the support members 28. The invention makes such positioning possible, provided of course that it is not precluded by design or enginerring considerations. The conveyor could also be placed below the support members either centrally or to one side, or in virtually any position desired within the limits of practical engineering requirements. Thus the invention provides for greater versatility of construction in tunnel boring machines.

Another advantage of the invention is that since the dual support members allow one drive cylinder to be extended while the other is retracted or held fixed, the drive cylinders can be used to augment the steering of the machine in the horizontal plane supplementing the horizontal steering shoes 38 and associated apparatus. For example, to turn the machine to the right, the drive cylinder and support member on the right hand side of the machine would be held in fixed position while the drive cylinder and support member on the left side of the machine would be extended. The procedure would be reversed to turn the machine to the left, the respective steering shoes 38 being used simultaneously in either case. Of course this mode of steering requires that the connections of the support members to the cutterhead support assembly and main beam allow for some horizontal pivotal movement. The vertical pivot pins 78 and 80 obviously allow such movement in the embodiment of FIGS. 1–4. In the embodiment of FIG. 5, it would be possible to provide sufficient movement in the joint to allow limited horizontal pivoting even though the pin 82 is horizontal.

Other forms of support members could be used as long as they provide for relative longitudinal movement of the cutterhead support assembly and the gripper assembly. For example, instead of two telescoping support elements, each support member might comprise a single beam with track means on which the gripper assembly could move longitudinally.

In this case it should be understood that, if the torque reaction is provided between the support member and the gripper assembly, as opposed to between the support member and the cutterhead support assembly, the torque reaction "end" would in effect be that portion of the support member adjacent the gripper assembly for any given position. It might also be considered to include any portion of the support member which might extend rearwardly from the portion adjacent the gripper assembly. In fact, many other variations of the present invention can be readily made by those skilled in the art. It is therefore intended that the scope of the invention be limited only by the claims which follow.

We claim:

1. A tunnel boring machine for progressively boring a tunnel while disposed therein, said machine comprising:

a rotary cutterhead assembly having cutting means mounted on a forward face thereof for engaging the end wall of said tunnel;

a cutterhead support assembly located generally rearwardly of said cutterhead assembly and on which said cutterhead assembly is mounted for rotation about an axis generally coincident with a longitudinal centerline of said tunnel;

a pair of elongate torque transmitting support members on opposite sides of and spaced from a plane through said axis, said support members precluding a longitudinally extending main beam on said plane through said axis which main beam would transmit a substantial amount of torque, each of said support members being connected to and extending rearwardly from said cutterhead support assembly, said support members each having a torque reaction end and each having a longitudinal centerline which remains substantially straight during operation of said machine;

a gripper assembly connected to said support members rearwardly of said cutterhead support assembly so that torque is transmitted from said cutterhead support assembly to said gripper assembly by said support members, said gripper assembly having radially extensible and retractable gripper elements for selectively gripping the walls of said tunnel;

means associated with each of said torque reaction ends to prevent pivotal movement of its respective support member about said torque reaction end, relative to the connected assembly of said machine, in a plane substantially perpendicular to a plane generally defined by said support members;

means associated with said support members permitting limited relative longitudinal movement between said cutterhead support assembly and said gripper assembly; and drive means associated with said cutterhead support assembly and said gripper assembly and operative to cause relative longitudinal movement between said cutterhead support assembly and said gripper assembly.

2. A tunnel boring machine according to claim 1 wherein said support members are diametrically opposed with respect to said axis and substantially radially spaced therefrom.

3. A tunnel boring machine according to claim 1 wherein said support members each comprise first and second telescopically connected support elements, each of said support members having its first support element connected to said cutter-head support assembly and its second support element connected to said gripper assembly.

4. A tunnel boring machine according to claim 3 wherein said drive means comprises a pair of hydraulic drive cylinder means carried by said support members.

5. A tunnel boring machine according to claim 4 wherein said support elements are hollow, each of said support members having one of said piston and cylinder means disposed therein.

6. A tunnel boring machine according to claim 1 further comprising an elongate conveyor adjacent said cutterhead assembly and extending rearwardly therefrom.

7. A tunnel boring machine according to claim 6 wherein said conveyor is disposed along one of said support members.

8. A tunnel boring machine according to claim 1 wherein said drive means comprises a pair of hydraulic piston and cylinder means each of which lies generally parallel to and adjacent one of said support members, said machine further comprising means associated with said support members permitting limited movement of said support members with respect to said cutterhead support assembly and also with respect to said gripper assembly in the plane of said support members and transverse to said axis, whereby steering of said machine transverse to said axis in the plane generally defined by said support members can by augmented by extending one of said piston and cylinder means while holding the other piston and cylinder means fixed.

9. A tunnel boring machine according to claim 1 wherein each of said torque reaction ends is pivoted to the connected assembly of said machine by a substantially vertical pin.

10. A tunnel boring machine according to claim 1 wherein said support members lie in a substantially horizontal plane, being disposed on opposite sides of said tunnel.

11. A tunnel boring machine according to claim 10 wherein each of said torque reaction ends is joined to the connected assembly of said machine by a pivot joint having a substantially horizontal pin, said machine further comprising means for selectively fixing said joint against movement in said plane perpendicular to the plane of said support members.

12. A tunnel boring machine according to claim 11 in which said fixing means comprises a hydraulic piston and cylinder inter-connecting each of said support members with the assembly connected to its torque reaction end.

13. A tunnel boring machine according to claim 1 wherein said torque reaction ends are at the front of said support members.

* * * * *

UNITED STATES PATENT AND TRADEMARK OFFICE

CERTIFICATE OF CORRECTION

PATENT NO. : 3,957,310

DATED : May 18, 1976

INVENTOR(S) : Douglas F. Winberg and Norman D. Dyer

It is certified that error appears in the above-identified patent and that said Letters Patent are hereby corrected as shown below:

On the title page, after item [76], please insert --Assignee: Dresser Industries, Inc., Dallas, Texas--.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*